United States Patent [19]

Repplinger

[11] 4,145,590

[45] Mar. 20, 1979

[54] ACTUATION FOR SEQUENTIALLY OPERATING PLURAL SWITCHES

[75] Inventor: Thomas J. Repplinger, Cary, Ill.

[73] Assignee: Otto Engineering, Inc., Carpentersville, Ill.

[21] Appl. No.: 833,457

[22] Filed: Sep. 15, 1977

[51] Int. Cl.[2] ..... H01H 3/20; H01H 41/00

[52] U.S. Cl. ..... 200/330; 200/153 LA; 200/5 C

[58] Field of Search ..... 200/5 C, 16 A, 18, 50 C, 200/153 T, 153 LA, 159 R, 330

[56] References Cited

U.S. PATENT DOCUMENTS

| | | | |
|---|---|---|---|
| 1,856,407 | 5/1932 | Apple | 200/5 C X |
| 2,813,160 | 11/1957 | Tong | 200/5 C X |
| 3,277,264 | 10/1966 | Barthell | 200/159 R |
| 3,300,600 | 1/1967 | Blomquist et al. | 200/50 C |
| 3,312,805 | 4/1967 | Bury | 200/159 R |
| 3,665,137 | 5/1972 | Puerner | 200/330 |
| 3,914,571 | 10/1975 | Kellogg et al. | 200/330 |
| 3,969,599 | 7/1976 | Terry | 200/153 T |

FOREIGN PATENT DOCUMENTS

| | | | |
|---|---|---|---|
| 1206985 | 12/1965 | Fed. Rep. of Germany | 200/330 |
| 1009464 | 11/1965 | United Kingdom | 200/330 |
| 1282497 | 10/1970 | United Kingdom | 200/330 |

*Primary Examiner*—Herbert F. Ross

[57] ABSTRACT

An electrical switch apparatus includes at least a pair of electrical switches and an actuating mechanism for sequentially actuating the switches. Each of the switches includes a push button which is movable between first and second positions, and the actuating mechanism includes an actuator which is movable between a first position, at least one intermediate position, and a third position. The actuator includes a cam for each of the push buttons. One of the cams is engageable with one of the push buttons to move the push button to its second position as the actuator moves to an intermediate position, and the other cam is engageable with the other push button to move the push button to its second position as the actuator moves to its third position. The actuator mechanism includes a first spring for resisting movement of the actuator from its first position to its intermediate position, and a second spring for providing a greater resisting force as the actuator moves from its intermediate position to its final position.

8 Claims, 10 Drawing Figures

ACTUATION FOR SEQUENTIALLY OPERATING PLURAL SWITCHES

BACKGROUND AND SUMMARY

This invention relates to electrical switches, and, more particularly, to an actuating mechanism for actuating a plurality of switches sequentially.

It is often desirable to actuate a plurality of electrical switches sequentially by a single actuator or push button. The invention provides such an actuating mechanism for seuqentially actuating two or more switches, and the actuating mechanism is particulary useful with high precision snap action switches. The actuating mechanism not only sequentially actuates a plurality of switches, but it provides the operator with tactile feel of the position of the actuator which enables the operator to know the position of the actuator, which switches have been actuated, and which switches have not been actuated.

DESCRIPTION OF THE DRAWING

The invention will be explained in conjunction with an illustrative embodiment shown in the accompanying drawing, in which —

DESCRIPTION OF SPECIFIC EMBODIMENT

Figure 1:
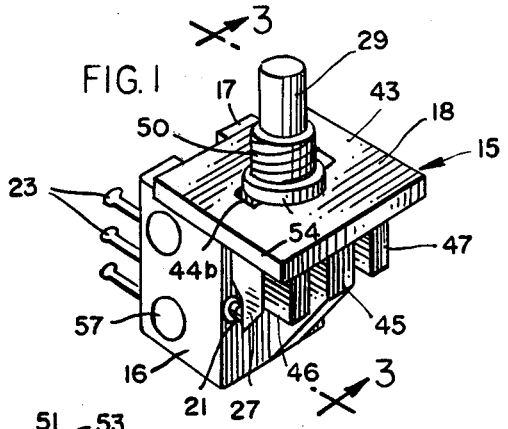
FIG. 1 is a perspective view of an electrical switch apparatus equipped with an actuating mechanism formed in accordance with the invention.

Referring first to FIGS. 1-4, the numeral 15 designates generally an electrical switch apparatus which includes a pair of electrical switches 16 and 17 mounted on an actuating mechanism 18. The particular switches illustrated are precision snap action basic switches which are manufactured to specifications independently of the actuating mechanism, and the dimensions of the actuating mechanism are selected to accommodate the switches. However, the actuating mechanism can also be used with other types of switches.

Each of the electrical switches 16 and 17 includes a box-like casing 19 and 20, respectively, an actuator or pushbutton 21 and 22, and terminals 23 which project from the casing for connecting the switch to an electrical circuit. Each of the pushbuttons can be depressed inwardly relative to the casing to move a snap action switch blade over center to actuate the switch. The switches can be either normally open or normally closed when the pushbutton is not depressed, or the switchblade can be movable to alternately connect a pair of terminals to a common terminal.

Since the details of such switches are well known and since the details themselves do not form a part of this invention, a description thereof is unnecessary. What is important is the cooperation between the actuators or pushbuttons 21 and 22 and the actuating mechanism which enables the pushbuttons to be depressed sequentially. Further, since the actuating mechanism can be used with other types of switches, for example, non-snap action switches, the term "pushbutton" as used herein and in the claims is meant to refer to the operating element of the switch which is moved by the operator to actuate, i.e., open or close, the switch.

The actuating mechanism 18 includes a molded plastic frame 25 and a molded plastic actuator 26 which is slidably mounted in the frame. As will be explained in detail hereinafter, the actuator includes a pair of cam portions 27 and 28 which sequentially depress the switch pushbuttons 21 and 22, respectively, as the actuator is pushed downwardly relative to the frame. The cams 27 and 28 of the actuator extend downwardly from and generally parallel with an elongated cylindrical guide portion 29, and the cams are laterally offset from the axis of the guide portion. As can be seen from FIGS. 7-9, the guide portion is hollow and is provided with an internal bore 30 which extends upwardly from the space between the cams. The guide portion includes a radially enlarged lower portion 31 adjacent the cams which provides an annular stop shoulder 32.

The cam 27 includes an actuating surface 33 which faces the pushbutton 21 of the switch 16. The actuating surface includes a first or lower portion 34 which extends generally parallel with and is aligned with the axis of the guide portion 29 (see especially FIG. 3), an intermediate or caming portion 35 which extends angularly toward the pushbutton 21, and an upper portion 36 which extends parallel with the lower portion but which is offset therefrom toward the switch 16.

The cam 28 similarly includes an actuating surface 37 which faces the pushbutton 22 of the switch 17. However, the cam surfaces 37 begins with a camming portion 38 which extends angularly toward the switch 17, and an upper portion 39 extends parallel to but offset from the axis of the guide portion 29.

Figure 6:
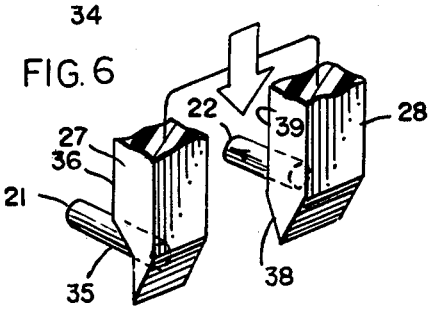
FIG. 6 is a view similar to FIG. 5 after the actuator has been depressed to actuate one of the switches.
Figure 7:
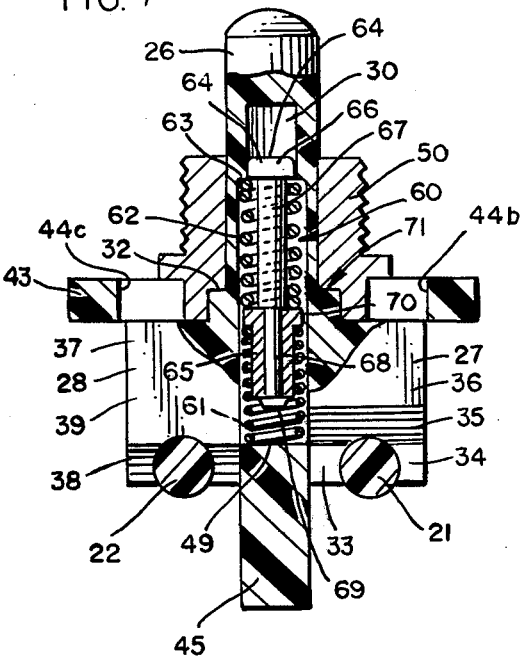
FIG. 7 is a fragmentary sectional view taken along the line 7—7 of FIG. 3.
Figure 8:
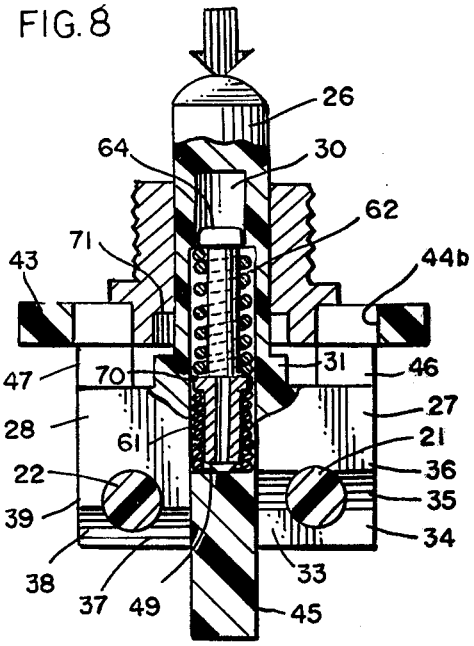
FIG. 8 is a view similar to FIG. 7 after the actuator has been depressed to actuate one of the switches.
Figure 9:
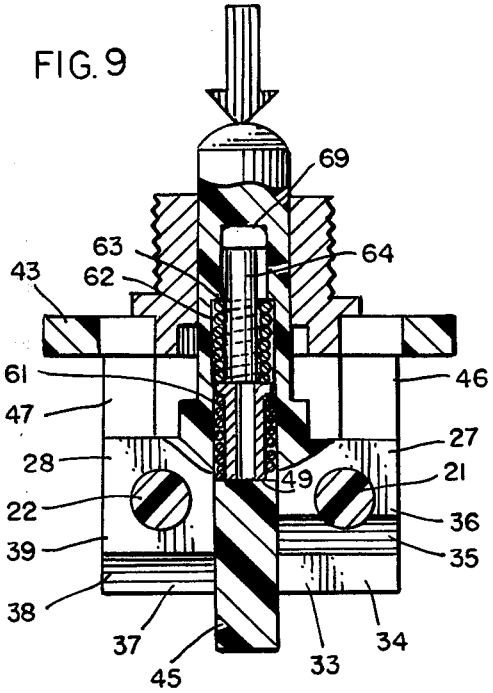
FIG. 9 is a view similar to FIGS. 7 and 8 after the actuator has been depressed to actuate both of the switches.

As can be seen from FIGS. 7-9, the camming surface 38 of the cam 28 is lower than the camming surface 35 of cam 27 and will engage the pushbutton 22 before the camming surface 35 engages the pushbutton 21 as the actuator is moved downwardly. The upper flat surfaces 36 and 39 extend parallel to each other, and each of the cams includes forward flat bearing surfaces 40 and 41 (FIGS. 5 and 6) which are in sliding contact with the frame 18.

The frame 18 includes a flat base 43 which is provided with an opening 44 (FIG. 2), a flat switch mounting wall 45 which extends perpendicularly from the center of the base, and a pair of bearing walls 46 and 47 which extend perpendicularly from the base on each side of the switch mounting wall and parallel to the switch mounting wall.

Figure 3:
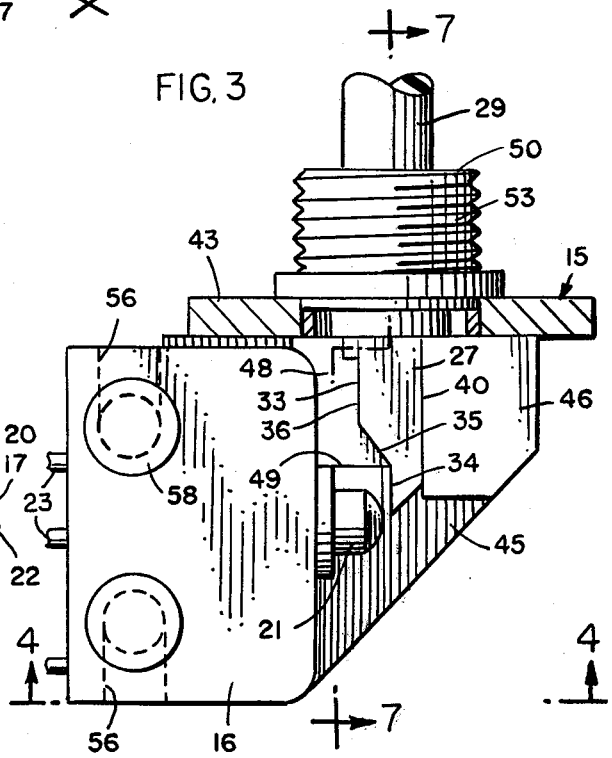
FIG. 3 is an enlarged side elevational view of the switch apparatus.

The opening 44 includes a generally circular central portion 44*a* and a pair of diametrically extending rectangular portions 44*b* and 44*c* which are sized to permit the cams 27 and 28 of the actuator to pass downwardly through the base of the frame. The switch mounting wall 45 is provided with a notch or recess 48 (FIG. 3)

below the opening 44, and the bottom edge 49 of the recess extends parallel to the base 43 just above the pushbutons 21 and 22.

Figure 2:
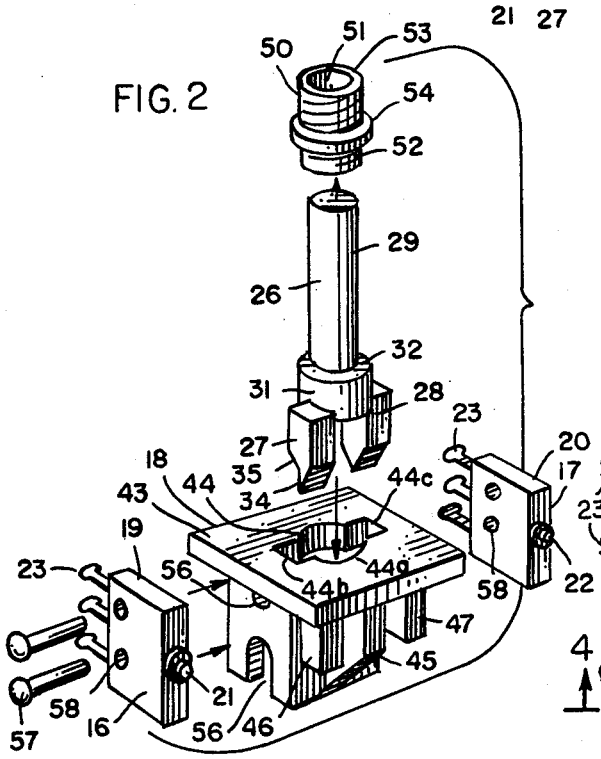
FIG. 2 is an exploded perspective view of the electrical switch apparatus.

When the actuator is inserted through the opening 44 in the base of the frame, the cams 27 and 28 straddle the switch mounting wall 45 of the frame. The actuator is maintained within the frame by a metal mounting collar 50 (FIG. 2). The collar has a circular bore 51 which guides the sliding movement of the cylindrical portion 29 of the actuator, a cylindrical bottom portion 52 which is secured within the circular portion 44*a* of the opening 44 in the frame, and an externally threaded upper portion 53 which can be used to mount the switch apparatus 15 on a control panel or the like. A radially outwardly extending flange 54 between the upper and lower portions 53 and 52 abuts the base 43 of the frame. The collar 50 positions the actuator so that the bearing surfaces 40 and 41 of the cams 27 and 28 bear against the bearing walls 46 and 47 of the frame (see FIG. 3) as the actuator moves up and down relative to the collar. The positions of the cams are thereby accurately maintained.

The switch mounting wall 45 is provided with a pair of U-shaped notches 56 (FIGS. 2 and 3), and the switches 16 and 17 are mounted on the switch mounting wall by a pair of rivets 57 which extend through openings 58 in the switch casings and the notches 56.

Referring now to FIGS. 7–9, the actuator is resiliently biased upwardly by a spring assembly 60 which is compressed between the bottom edge 49 of the recess in the switch mounting wall 45 and the upper end portion of the bore 30 in the actuator. The spring assembly includes a lower coil spring 61 which abuts the edge 49 of the mounting wall, an upper spring 62 which abuts an annular shoulder 63 in the bore of the actuator, a guide pin 64, and a guide sleeve 65.

The guide pin 64 includes a head 66 which has a diameter slightly less than the diameter of the actuator bore above the shoulder 63, a first shank portion 67 which extends through the upper coil spring 62, and a second, reduced-diameter shank portion 68. The guide sleeve 65 is retained on the second shank portion by peening over the lower end 69 of the pin. The guide sleeve extends through the lower coil spring and includes an upper flange 70 which abuts the shoulder between the two shank portions and which extends radially outwardly between the two springs. The upper spring 62 is maintained in a preloaded or compressed state between the flange 70 and the head 66 of the guide pin.

Figure 5:
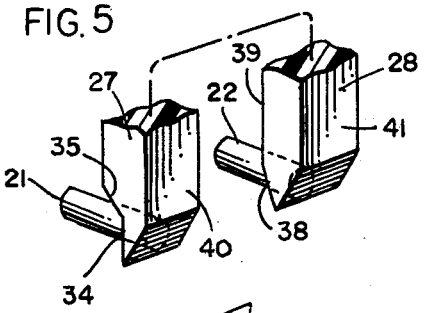
FIG. 5 is a fragmentary perspective view showing the relationship between the actuator and the push buttons of the electrical switches prior to actuation.
Figure 4:
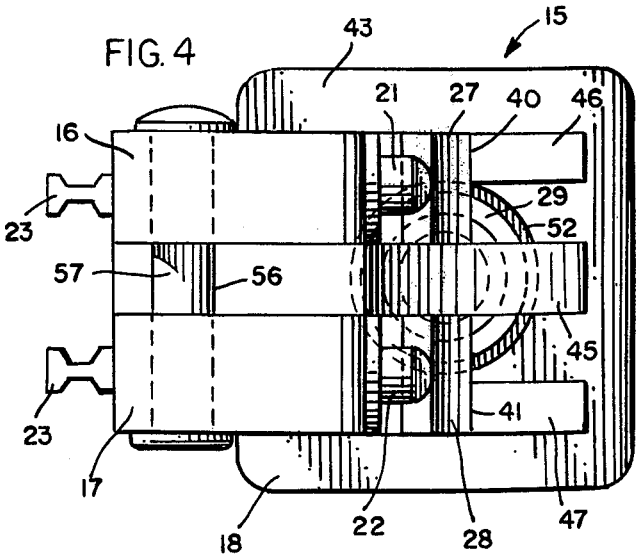
FIG. 4 is a bottom plan view of the switch apparatus.

FIGS. 3, 5, and 7 illustrate the switch apparatus before the actuator 26 is actuated by the operator. The spring assembly 62 maintains the shoulder 32 of the actuator against shoulder 71 of the mounting collar 50. When the actuator is in this position, the pushbutton 22 of the switch 17 is adjacent the inclined cam surface 38 of the cam 28, but the pushbutton is not depressed by the cam. The pushbutton 21 of the switch 16 is aligned with but spaced from the lower surface 34 of the cam 27, and this pushbutton is also not depressed.

When the actuator is pushed downwardly from the position illustrated in FIGS. 5 and 7 to the position illustrated in FIGS. 6 and 8, the cam surface 38 of the cam 28 depresses the pushbutton 22, and this pushbutton is maintained in its depressed position by the flat upper surface 39 of the cam 28. However, the pushbutton 21 is not depresssed. The cam surface 35 of the cam 27 will move into position adjacent the pushbutton 21 but will not depress the pushbutton.

When the actuator moves from its FIG. 7 to its FIG. 8 position, the lower spring 61 is compressed between the edge 49 of the switch mounting wall and the flange 70 of the guide sleeve. The spring constant of the upper spring 62 is greater than the spring constant of the lower spring, and the difference in spring constants plus the preload maintained on the upper spring ensures that the lower spring will become fully compressed before the upper spring will be compressed beyond its preloaded condition.

When the actuator is pushed downwardly from the position illustrated in FIG. 8 to the position illustrated in FIG. 9, the pushbutton 21 will be depressed by the cam surface 35 and will be held in its depressed position by the flat upper surface 36 of the cam 27. The pushbutton 22 will be maintained in its depressed position by the flat upper surface 39 of the cam 28.

When the actuator moves from its FIG. 8 to its FIG. 9 position, the upper spring 62 begins to compress when the lower spring 61 becomes fully compressed. The lower end 69 of the guide pin 64 abuts the edge 40 of the mounting wall, and the shoulder 63 of the actuator moves the upper spring downwardly away from the head 66 of the guide pin. As the actuator continues to move downwardly, the upper spring is compressed between the shoulder 63 and the flange 70 of the guide sleeve.

From the foregoing it is evident that before the actuator is depressed, neither of the switches 16 or 17 is actuated. When the actuator is moved to its FIG. 8 position, only the switch 17 is actuated, and when the actuator is moved to its FIG. 9 position, both of the switches are actuated.

The sequential actuation of the switches can be reversed by reducing the downward operating force on the actuator sufficiently to allow the actuator to be returned from its FIG. 9 position to its FIG. 8 position by the upper spring 62. The pushbutton 21 will be allowed to return to its original non-actuated position as the cam surface 35 of the cam 27 moves upwardly, but the pushbutton 22 will remain depressed. When the actuating force on the actuator is removed, the actuator will be returned to its FIG. 7 position by the lower spring 61, and the pushbutton 22 will be allowed to return to its original non-actuated position.

Figure 10:
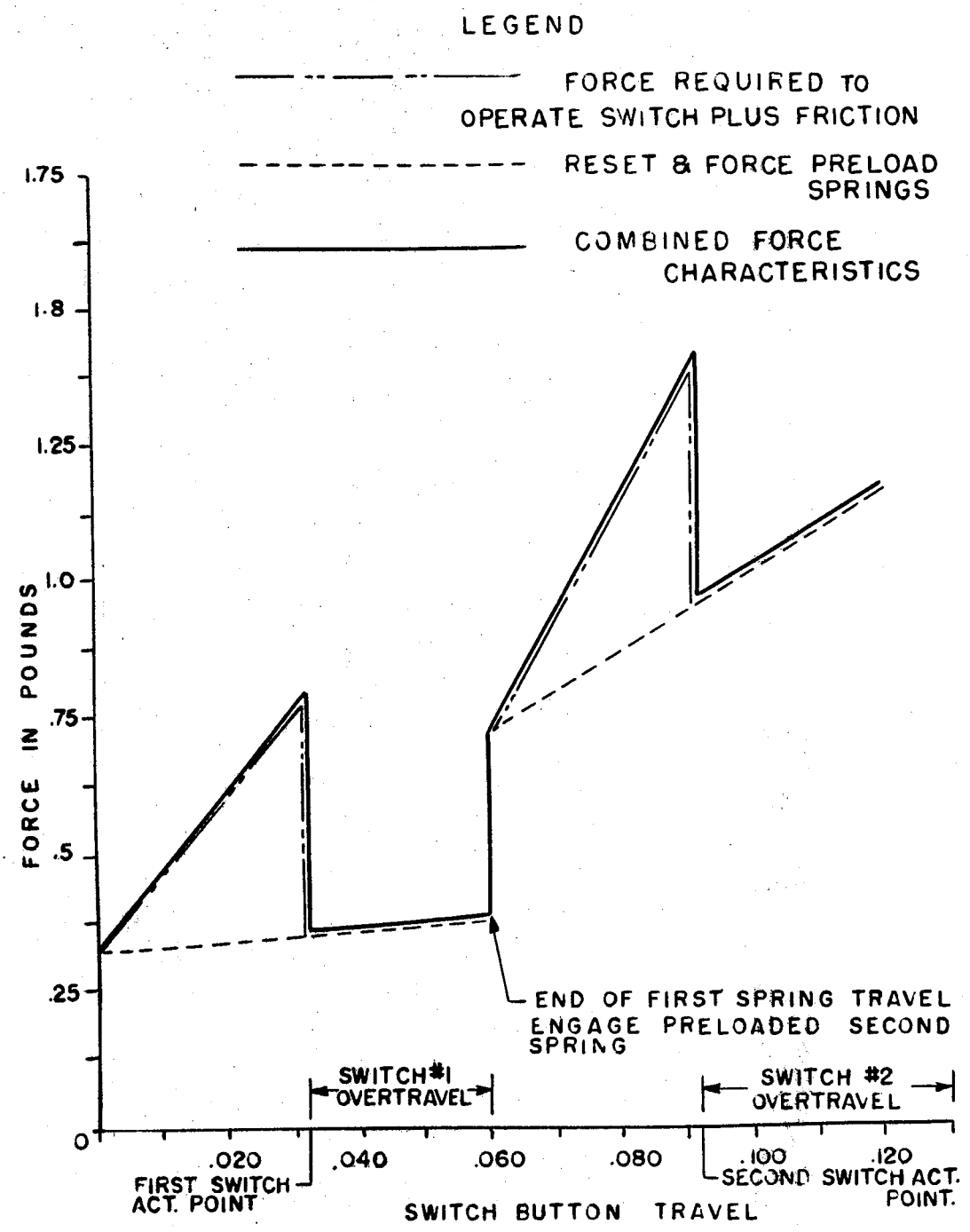
FIG. 10 is a force diagram showing the forces required to depress the actuator.

The different size springs 61 and 62 which resist actuation of the actuator 26 provide the operator with a tactile feel of the positions of the actuator. The spring forces which resist downward movement of the actuator are plotted against movement of the actuator in FIG. 10 for one specific embodiment of the switch apparatus using snap action switches 16 and 17. As the actuator moves from 0 to about 0.032 inch, movement of the actuator is resisted by a combination of the spring forces exerted on the actuator by the lower spring 61 and the force which resists depressing of the pushbutton 22. The force resisting depression of the pushbutton 22 is a combination of the force exerted by the snap action switchblade of the switch 17 which resists movement over center and the force required to depress the pushbutton by the angled cam surface. The snap action switchblade of the switch 17 snaps over center after about 0.032 inch of movement of the actuator, and further movement of the actuator is resisted only by the lower spring 61. Accordingly, the force required to further depress the actuator beyond 0.032 inch drops from about 0.80 pounds to about 0.35 pounds, thereby providing tactile evidence that the first switch has been actuated.

The lower spring is sized to become fully compressed at about the same time that the pushbutton 21 of the switch 16 begins to be depressed by the cam surface 35 of the cam 27. Further downward movement of the actuator is then resisted by the relatively high force exerted on the actuator by the strong preloaded upper spring 62 and the force which resists depression of the pushbutton 21. As previously described, the force resisting depression of the pushbutton is a combination of the force provided by the snap action switchblade of the switch and the force required to depress the pushbutton by the angled cam surface. The combination of the these forces, particularly the relatively high force provided by the strong preloaded spring 62, provide tactile evidence that actuation of the secnd switch has begun. The force required to depress the actuator in order to begin actuation of the second switch jumps from about 0.38 pounds to about 0.72 pounds, and the force required to move the actuator from 0.060 inch to 0.092 inch in order to actuate the second switch increases to about 1.4 pounds. When the snap action switchblade of the second swich 16 moves over center, the force required to depress the actuator drops from 1.4 pounds to about 0.95 pounds, thereby providing tactile evidence that the second switch has been actuated.

The actuating mechanism similarly provides tactile feel of the position of the actuator when the actuator is allowed to move upwardly. When the actuator rises sufficiently to bring the strong upper spring 62 into engagement with the head 66 of the guide pin, a force on the actuator is no longer required to resist the force of the upper spring, and the operator knows that the actuator has moved upwardly sufficiently to allow the switch 16 to return to its non-actuated position.

Although the tactile feed provided by the spring assembly is particularly advantageous, the actuating mechanism can be used to sequentially actuate a plurality of switches without the spring assembly. In that event, a simple return spring might be used to return the actuator when it is released.

Although I have described the actuator mechanism in conjunction with a pair of switches, it will be understood that the actuating mechanism could be modified to actuate more switches. For example, additional cam surfaces could be provided for actuating additional switches at different times, or the additional switches could be actuated at the same time as one of the other switches. Further, although I have described the actuator as maintaining each switch in its actuated position as the actuator is depressed beyond the actuating point, the shape of the cam surfaces could be varied to permit one or more switches to return to an unactuated position as the actuator is depressed further.

While in the foregoing specification a detailed description of a specific embodiment of the invention was set forth for the purpose of illustration, it will be understood that may of the details hereingiven may be varied considerably by those skilled in the art without departing from the spirit and scope of the invention.

I claim:

1. An electrical switch apparatus comprising a frame, at least a pair of electrical switches mounted on the frame, each of the switches having a pushbutton movable between a first position and a second position, an actuator reciprocably mounted on the frame for reciprocation between a first position, at least one intermediate position, and a third position, the actuator including at least a pair of cam surfaces which are spaced apart in a direction extending generally perpendicularly to the direction of reciprocation of the actuator, each of the cam surfaces being engageable with the pushbutton of one of the electrical switches for moving the pushbutton from its first to its second position as the actuator moves from its first position to its third position, the cam surfaces being constructed and arranged so that the pushbuttons of both of the switches will be in their first positions when the actuator is in its first position, one of the cam surfaces being engageable with the pushbutton of one of the switches to move the pushbutton to its second position when the actuator is in its intermediate position, the other cam surface being engageable with the pushbutton of the other switch to move the pushbutton to its second position when the actuator is in its third position whereby the two switches are actuated sequentially as the actuator moves from its first position to its third position.

2. An actuating mechanism for actuating at least a pair of electrical switches, each of the switches having a pushbutton movable between a first position and a second position, the actuating mechanism comprising:

a frame to which the electrical switches can be connected, an actuator reciprocably mounted on the frame for reciprocation between a first position, at least one intermediate position, and a third position, the actuator including at least a pair of cam surfaces which are spaced apart in a direction extending generally perpendicularly to the direction of reciprocation of the actuator, each of the cam surfaces being adapted for engagement with the pushbutton of one of the electrical switches for moving the pushbutton from its first to its second position as the actuator moves from its first position to its third position, the cam surfaces being constructed and arranged so that the pushbuttons of both of the switches will be in their first position when the actuator is in its first position, one of the cam surfaces being engageable with the pushbutton of one of the switches to move the pushbutton to its second position when the actuator is in its intermediate position, the other cam surface being engageable with the pushbutton of the other switch to move the pushbutton to its second position when the actuator is in its third position whereby the two switches are actuated sequentially as the actuator moves from its first position to its third position.

3. The structure of claim 2 in which said one cam surface maintains the pushbutton of said one switch in its second position as the actuator moves from its intermediate position to its third position whereby both of the pushbuttons are maintained in their second position by the cam surface when the actuator is in its third position.

4. The structure of claim 2 in which the actuator is mounted on the frame for reciprocation in a direction generally perpendicular to the direction in which the pushbuttons are movable, each of the cam surfaces comprising an inclined surface on the actuator engageable with the pushbutton of the associated switch as the actuator reciprocates on the frame, the inclined surfaces of the two cam surfaces being spaced apart in a direction parallel to the direction in which the actuator reciprocates.

5. The structure of claim 2 including a first spring engageable with the actuator for resisting movement of the actuator from its first position to its intermediate position and a second spring engageable with the actuator for resisting movement of the actuator from its intermediate position to its third position, the second spring exerting a greater resisting force on the actuator than the first spring.

6. The structure of claim 2 including first and second coil springs extending coaxially and parallel to the direction in which the actuator is movable, the spring constant of the first spring being less than the spring constant of the second spring, one end of one of the coil springs engaging the frame and one end of the other coil spring engaging the actuator, the first spring being compressed as the actuator moves from its first position to its intermediate position and the second spring being compressed as the actuator moves from its intermediate position to its third positon whereby a tactilely evident greater resisting force is exerted on the actuator when the actuator moves between its intermediate position and its third position than when the actuator moves from its first position to its intermediate position.

7. The structure of claim 6 in which the second spring is compressed when the actuator is in its first position to provide a preload force resisting movement of the actuator which must be overcome when the second spring begins to be further compressed by the actuator.

8. The structure of claim 2 including first and second coil springs extending coaxially and parallel to the direction in which the actuator is movable, one end of one of the coil springs engaging the frame and one end of the other coil spring engaging the actuator, one of the coil springs being compressible as the actator moves from its first position to its intermediate position to provide a force resisting movement of the actuator, the other spring being in a preloaded compressed state and being compressible when the actuator moves from its intermediate position to its third position to provide a force resisting movement of the actuator.

* * * * *